US011974663B2

(12) United States Patent
Lin

(10) Patent No.: US 11,974,663 B2
(45) Date of Patent: May 7, 2024

(54) FOLDING TABLE

(71) Applicant: GAIN-PING CO., LTD., New Taipei (TW)

(72) Inventor: Chiu-Ting Lin, New Taipei (TW)

(73) Assignee: GAIN-PING CO., LTD., New Taipei (TW)

( * ) Notice: Subject to any disclaimer, the term of this patent is extended or adjusted under 35 U.S.C. 154(b) by 28 days.

(21) Appl. No.: 17/936,388

(22) Filed: Sep. 29, 2022

(65) Prior Publication Data

US 2024/0108123 A1 Apr. 4, 2024

(51) Int. Cl.
*A47B 3/08* (2006.01)
*A47B 21/06* (2006.01)

(52) U.S. Cl.
CPC ..... *A47B 3/08* (2013.01); *A47B 21/06* (2013.01)

(58) Field of Classification Search
CPC ..... A47B 3/08; A47B 21/06
USPC ..... 108/115, 50.02; 312/223.6
See application file for complete search history.

(56) References Cited

U.S. PATENT DOCUMENTS 5,337,657 A * 8/1994 Diffrient ..... A47B 21/06 108/115
6,164,217 A * 12/2000 Prendergast ..... A47B 3/00 248/167
6,314,892 B1 * 11/2001 Favini ..... A47B 3/0803 108/115
6,336,414 B1 * 1/2002 Stewart ..... A47B 3/0815 108/115
6,637,352 B1 * 10/2003 Thode ..... A47B 3/08 108/115
6,845,723 B2 * 1/2005 Kottman ..... A47B 3/00 248/188.4
7,066,098 B2 * 6/2006 Blasen ..... A47B 7/02 108/115
7,765,938 B2 * 8/2010 Piretti ..... A47B 7/02 108/115
8,069,795 B1 * 12/2011 Williams ..... A47B 7/02 108/115
8,091,488 B2 * 1/2012 Chirea ..... A47B 3/08 108/115
8,381,664 B2 * 2/2013 Prendergast ..... A47B 3/00 248/167
8,539,888 B2 * 9/2013 Hernandez ..... A47B 85/06 108/115
9,950,728 B2 * 4/2018 Weiser ..... B65G 67/02
11,122,886 B1 * 9/2021 Conway ..... A47B 3/0803
11,737,556 B1 * 8/2023 Saterbak ..... A47B 3/0912 108/77

(Continued)

FOREIGN PATENT DOCUMENTS

CN 208192568 U 12/2018
CN 217039252 U 7/2022

(Continued)

*Primary Examiner* — Jose V Chen
(74) *Attorney, Agent, or Firm* — CKC & Partners Co., LLC

(57) ABSTRACT

A folding table includes a table board, a supporting frame, a folding module, two supporting columns and a pair of caster feet. The folding module is fixed between the table board and the supporting frame, so that the table board is able to rotate and fix on the supporting frame. The two supporting columns are installed to the supporting frame, and the caster feet are respectively installed to the supporting columns.

9 Claims, 10 Drawing Sheets

(56) References Cited

U.S. PATENT DOCUMENTS

| | | | | |
|---|---|---|---|---|
| 11,757,267 | B1 * | 9/2023 | Reddig | H02G 3/0406 174/68.3 |
| 2002/0043183 | A1 * | 4/2002 | Insalaco | A47B 21/06 108/50.02 |
| 2004/0237854 | A1 * | 12/2004 | Piretti | A47B 7/02 108/115 |
| 2005/0039642 | A1 * | 2/2005 | Cornelius | A47B 7/02 108/115 |
| 2007/0209559 | A1 * | 9/2007 | Mockel | A47B 7/02 108/115 |
| 2007/0261611 | A1 * | 11/2007 | Kumazawa | A47B 3/0815 108/115 |
| 2009/0283020 | A1 * | 11/2009 | Hsu | A47B 3/0815 108/115 |
| 2010/0024687 | A1 * | 2/2010 | Preiss | A47B 21/06 108/50.02 |
| 2010/0258042 | A1 * | 10/2010 | Rutz | A47B 3/0818 108/115 |
| 2011/0139042 | A1 * | 6/2011 | Korb | A47B 3/00 108/115 |
| 2013/0284076 | A1 * | 10/2013 | Okuda | A47B 3/08 108/115 |
| 2014/0158024 | A1 * | 6/2014 | Henriott | A47B 3/08 108/27 |
| 2015/0187460 | A1 * | 7/2015 | DeLoache | A47B 21/06 248/68.1 |
| 2018/0338608 | A1 * | 11/2018 | Keller | A47B 9/12 |
| 2019/0307242 | A1 * | 10/2019 | Payne | A47B 41/02 |
| 2020/0390237 | A1 * | 12/2020 | Cvek | H01R 13/73 |
| 2021/0015250 | A1 * | 1/2021 | Chu | A47B 17/02 |
| 2022/0395090 | A1 * | 12/2022 | Van Faasen | A47B 21/06 |
| 2023/0030047 | A1 * | 2/2023 | Roussel | A47B 21/06 |

FOREIGN PATENT DOCUMENTS

| | | | |
|---|---|---|---|
| EP | 1915922 | A1 | 4/2008 |
| TW | M636943 | U | 1/2023 |

* cited by examiner

FOLDING TABLE

BACKGROUND

Technical Field

The present disclosure relates to a folding table. More particularly, the present disclosure relates to a modular folding table.

Description of Related Art

With the progress of the society, the designs of various types of furniture are also more diversified. However, due to the dense population of the city, people's living space is gradually narrow. How to make full use of the limited space through proper furniture configuration, release the existing space to store the furniture and use the furniture space in time when needed may provide users with effective space utilization.

The folding table can be conveniently stored, and the folding table can be folded and stored when not in use to reduce the occupied space, and therefore the folding table has become one of the commonly used equipment at home and in the workplace. In addition, the table board of the folding table can be rotated according to the needs of use, and the folding table can be simply stored in any corner of the home or meeting room when not in use, without taking up additional space.

In addition, the simple appearance of the folding table can adapt to various home styles or be used as a work table, a conference table, or even a display table. Therefore, the folding table can be widely used in home life and in the office.

Therefore, how to provide a more stable and safe folding table with simple operation mode is a direction of active efforts of manufacturers and designers in this field.

SUMMARY

The summary of the present invention is intended to provide a simplified description of the disclosure to enable readers to have a basic understanding of the disclosure. The summary of the present invention is not a complete overview of the disclosure, and it is not intended to point out the importance of the embodiments/key elements of the present invention or define the scope of the invention.

One objective of the embodiments of the present invention is to provide a folding table able to be conveniently stocked, transported, used and stored.

To achieve these and other advantages and in accordance with the objective of the embodiments of the present invention, as the embodiment broadly describes herein, the embodiments of the present invention provides a folding table including a table board, a supporting frame, a folding module, two supporting columns, and a pair of caster feet. The folding module is fixed between the table board and the supporting frame to allow the table board able to rotate and fix on the supporting frame, two supporting columns are installed to the supporting frame and the caster feet are respectively installed to the supporting columns.

In some embodiments, each of the supporting columns includes a connecting joint inserted into the supporting frame to connect together.

In some embodiments, the connecting joint includes an inclined connection surface to connect to an inclined fixing surface of the supporting frame.

In some embodiments, the supporting frame includes two supporting beams and two connecting brackets fixing two ends of the supporting beams to form a rectangular supporting frame.

In some embodiments, the connecting brackets include wire fixing hooks to fix power wires or signal wires.

In some embodiments, the folding module includes two folding frames and a release rod. The two folding frames are respectively fixed on two ends of a lower surface of the table board and the release rod is connected between the folding frames.

In some embodiments, each of the folding frames includes a connecting rod, a release slide block, a slide rail and an L shaped lock. The release slide block includes a plurality of length adjustment holes, and the connecting rod is connected to one of the length adjustment holes. The release slide block is movable to be installed in the slide rail and the L shaped lock is pivoted on the slide rail.

In some embodiments, the L shaped lock includes a first claw and a second claw, the release slide block includes a first positioning pin and a second positioning pin, the first claw is configured to lock to the first positioning pin, and the second claw is configured to lock to the second positioning pin to position the table board in a horizontal position or a vertical position.

In some embodiments, each of the folding frames further includes a protective shell accommodating the release slide block, the slide rail, a portion of the connecting rod and a portion of the L shaped lock, and the second claw of the L shaped lock and the second positioning pin of the release slide block are hidden in the protective shell.

In some embodiments, the first positioning pin and the second positioning pin of the release slide block respectively include a plastic positioning pin bushing.

In some embodiments, the L shaped lock is pivotally connected to a rotating shaft of the slide rail, and the rotating shaft is a plastic rotating shaft.

In some embodiments, the folding table further includes two wire clamp modules installed on the supporting columns.

In some embodiments, each of the wire clamp modules includes a first wire holder and a second wire holder. The first wire holder is installed on one of the supporting columns and the second wire holder is detachably connected to the first wire holder. When the second wire holder and the first wire holder are separated, the second wire holder may be installed on a wire clamp fixing hole of the one of the supporting columns.

In some embodiments, the caster feet include a first span and a second span, the first span is greater than the second span, and the first span is adjacent to the release rod.

Hence, the folding table disclosed in the present invention can not only be conveniently stored and transported, but also can be conveniently installed and accommodated, and the overall rigidity and strength of the folding table can be effectively improved through the enhanced structural design. In addition, the positioning pins and the claws hidden in the protective shell may increase the safety during use, and effectively improve the utilization field and safety of the folding table.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
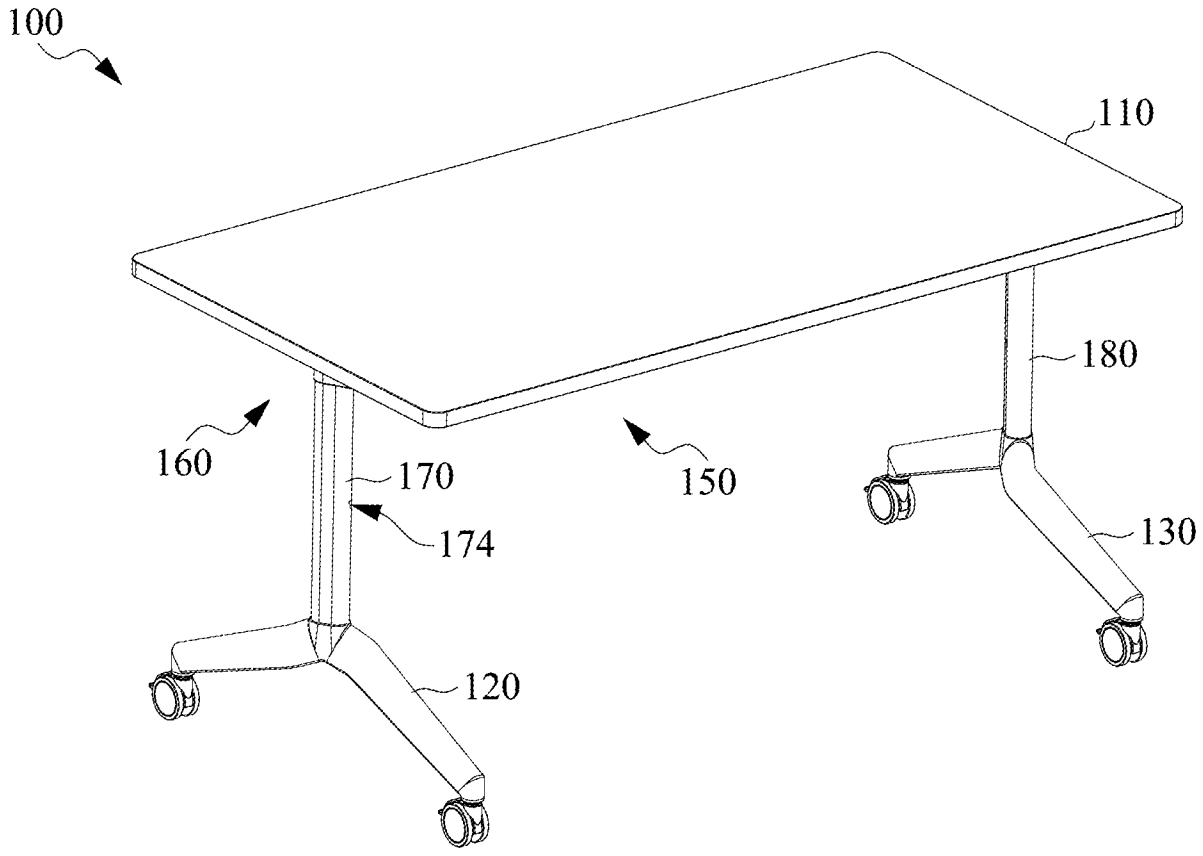
FIG. 1 illustrates a schematic perspective diagram of a folding table according to one embodiment of the present invention.

The following is a detailed description of the embodiments in conjunction with the accompanying drawings, but the provided embodiments are not intended to limit the scope of the disclosure, and the description of the structure and operation is not used to limit the execution sequence thereof. The structure of the recombination of components and the resulting devices with equal functions are all within the scope of this disclosure. In addition, the drawings are for illustration purposes only, and are not drawn according to the original scale. For ease of understanding, the same reference numbers are used in the drawings and the description to refer to the same or like parts.

In addition, the terms used in the entire description and the scope of the patent application, unless otherwise specified, usually have the usual meaning of each term used in this field, in the content disclosed here and in the special content. Some terms used to describe the disclosure are discussed below or elsewhere in this specification to provide additional guidance to those skilled in the art in the disclosure.

In the implementation mode and the scope of the present application, unless the article is specifically limited in the context, "a" and "the" can generally refer to a single or pluralities. In the steps, the numbering is only used to conveniently describe the steps, rather than to limit the sequence and implementation.

Secondly, the words "comprising", "including", "having", "containing" and the like used in the present application are all open language, meaning including but not limited to.

Figure 2:
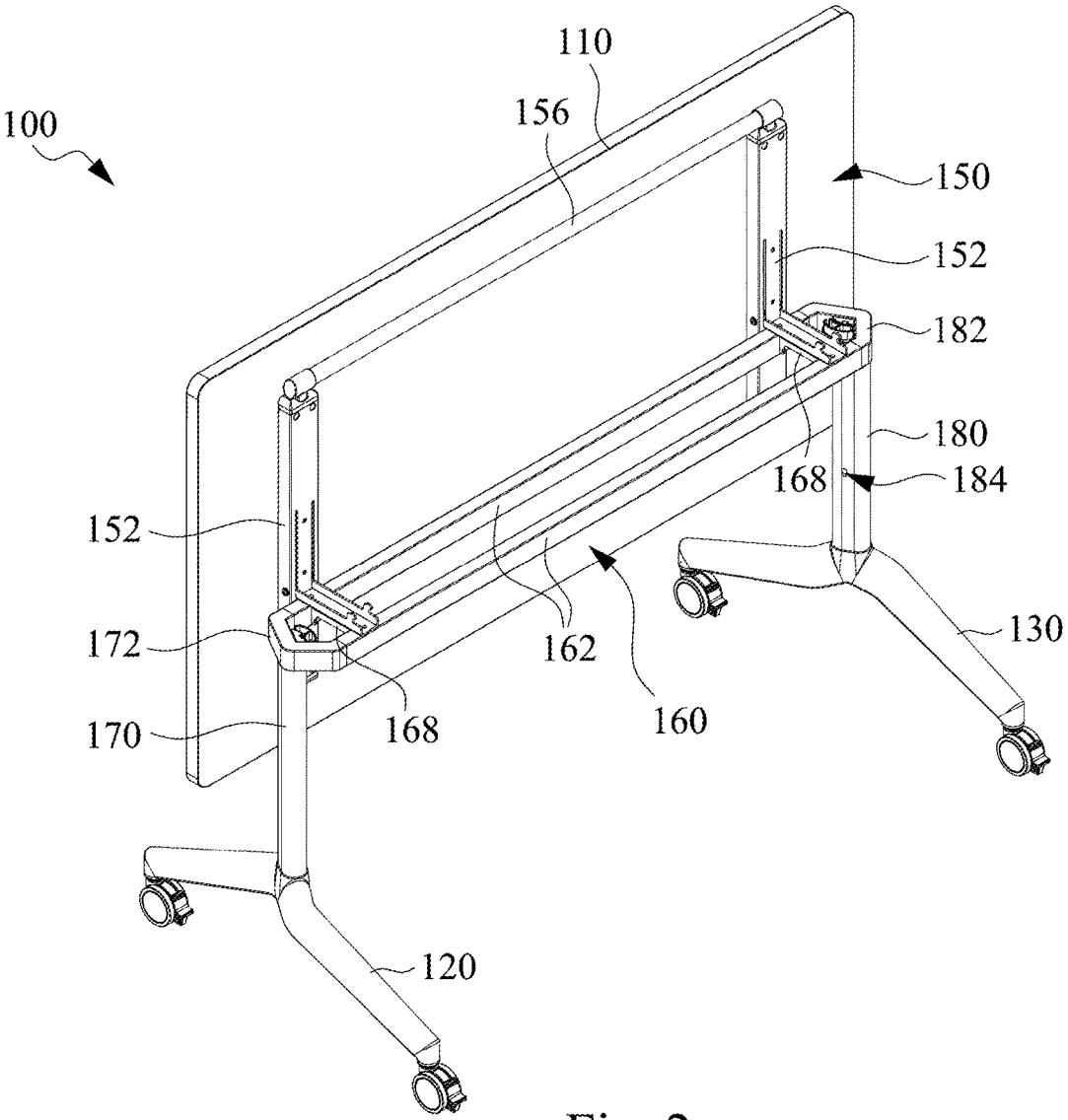
FIG. 2 is a schematic diagram of the folding table in a storage status.
Figure 3:
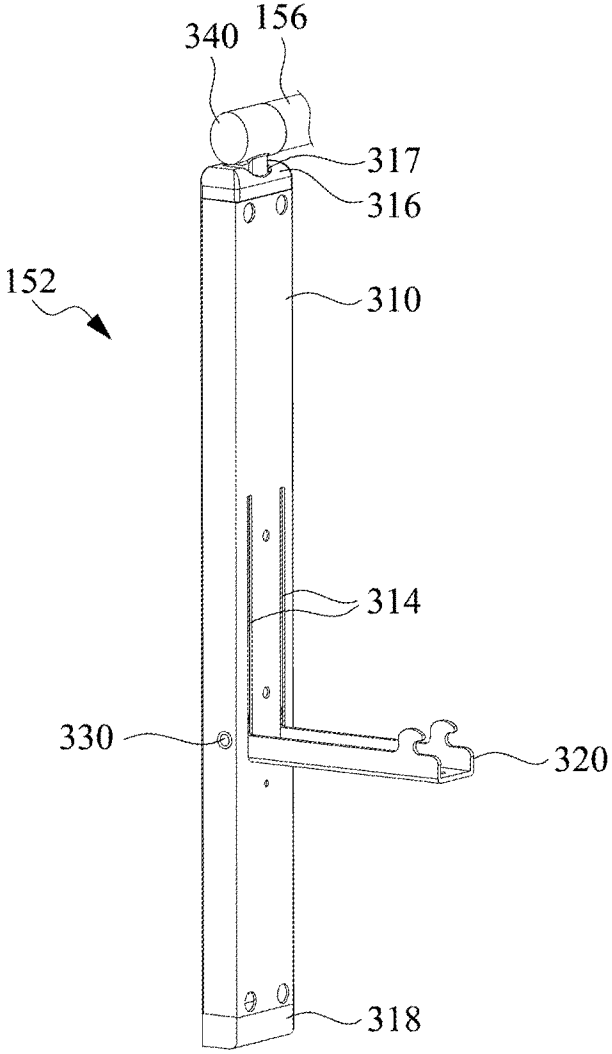
FIG. 3 is a schematic perspective diagram of the folding frame of the folding table.
Figure 4:
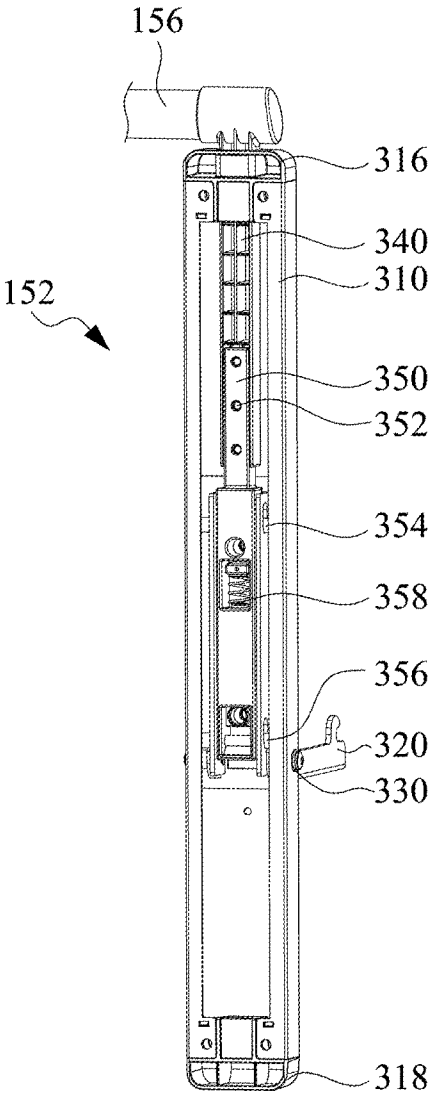
FIG. 4 is a schematic rear view of the folding frame of the folding table shown in FIG. 3.
Figure 5:
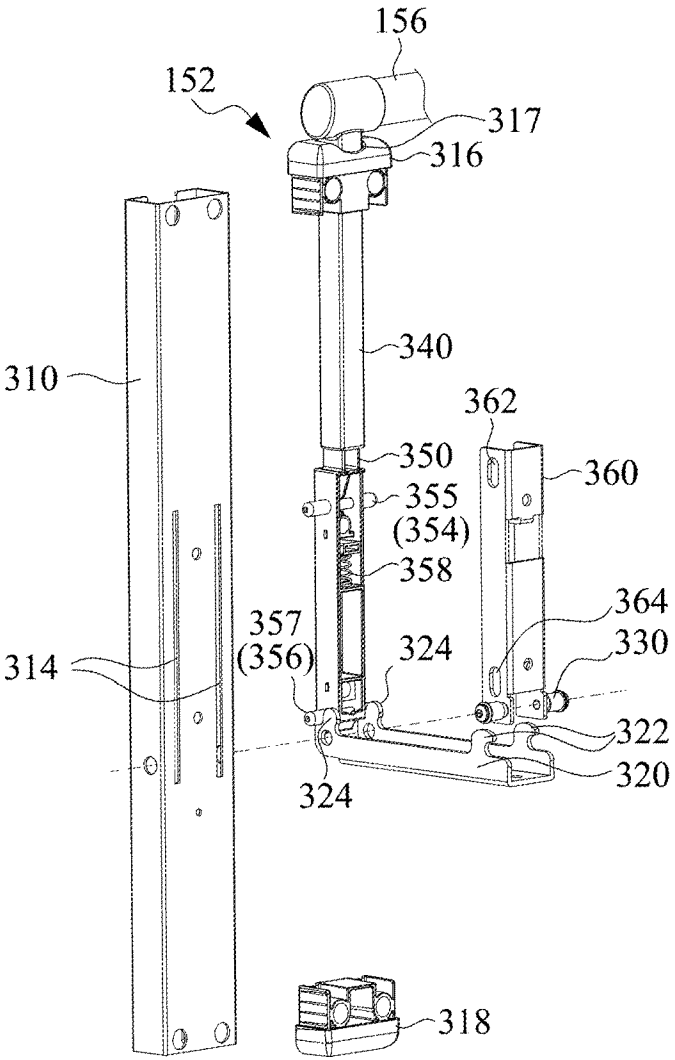
FIG. 5 is an exploded schematic diagram of partial components of the folding frames of the folding table shown in FIG. 3.
Figure 6:
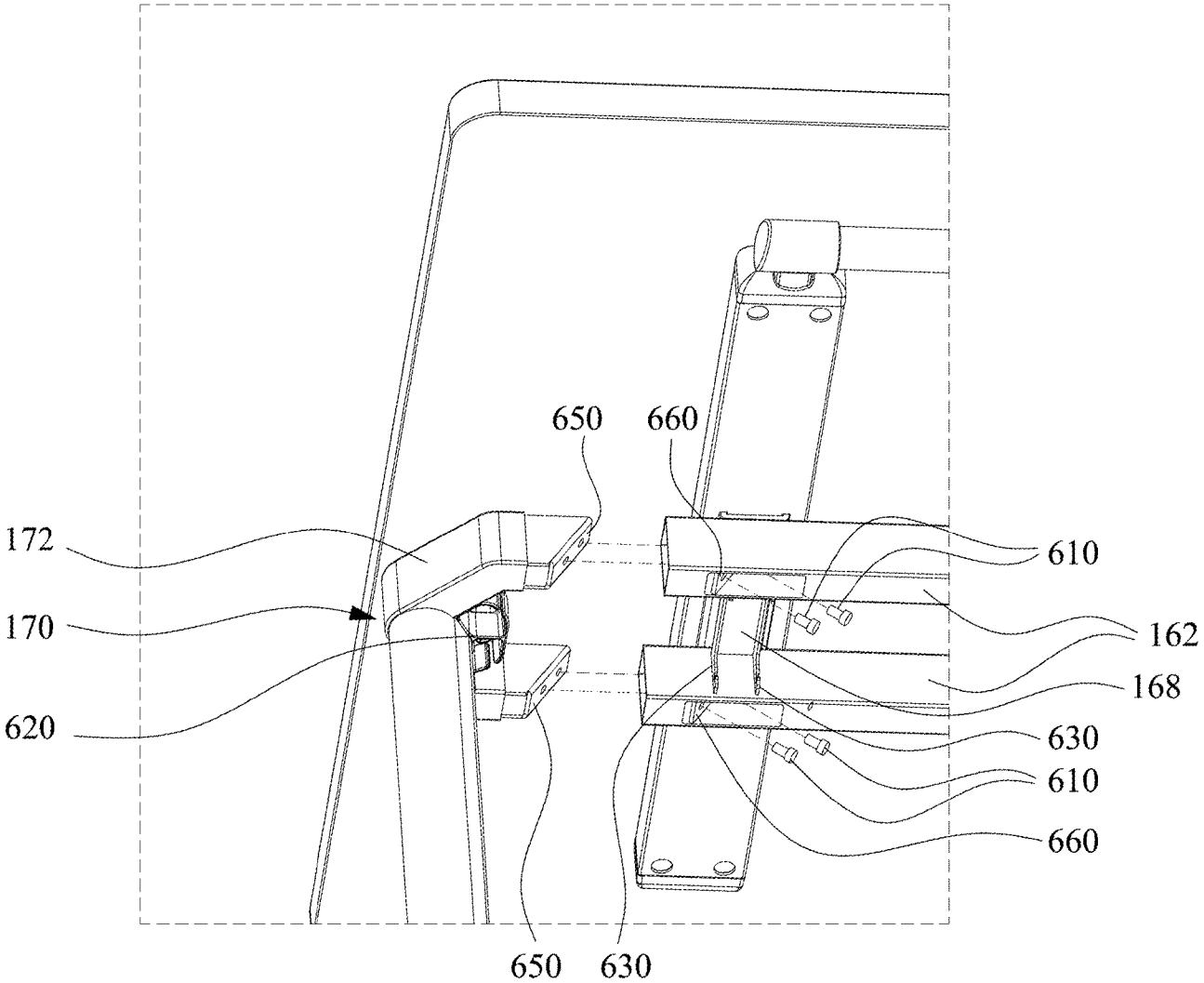
FIG. 6 is a schematic diagram of the connecting joint of the supporting column and the supporting frame of the folding table before assembly.
Figure 7:
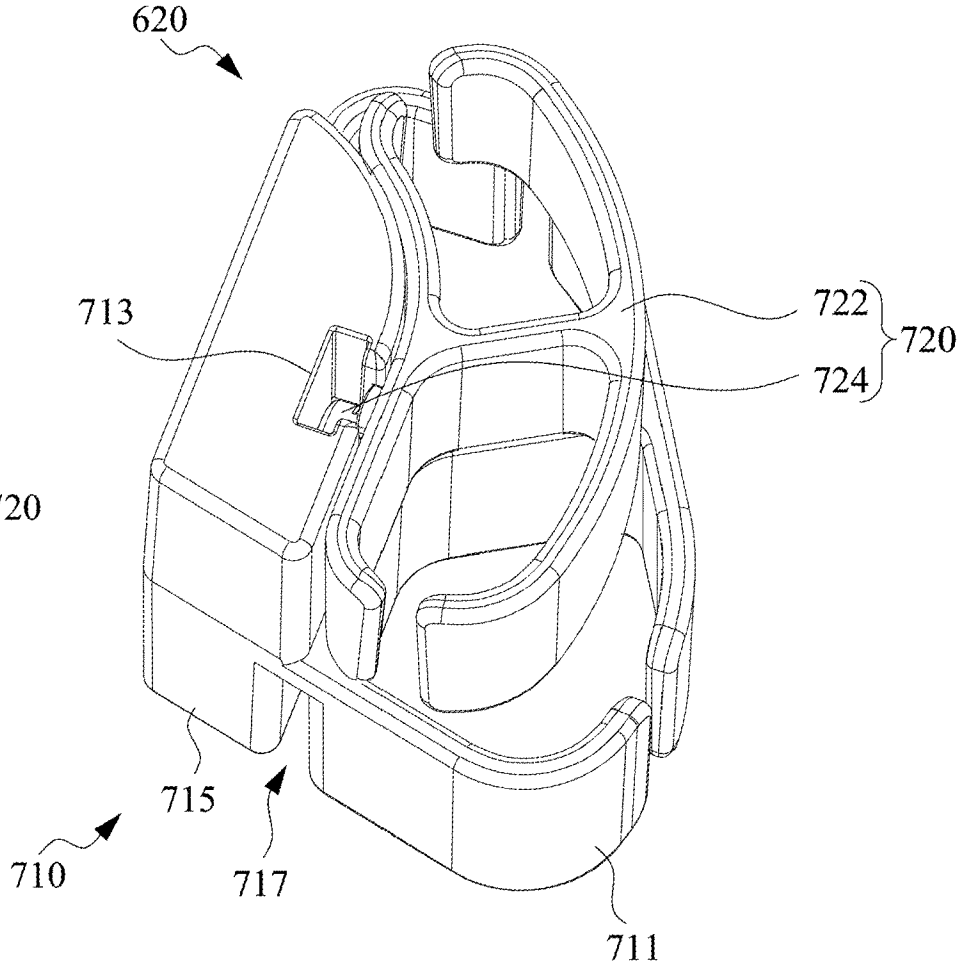
FIG. 7 is a schematic diagram of the wire clamp module of the folding table.
Figure 7:
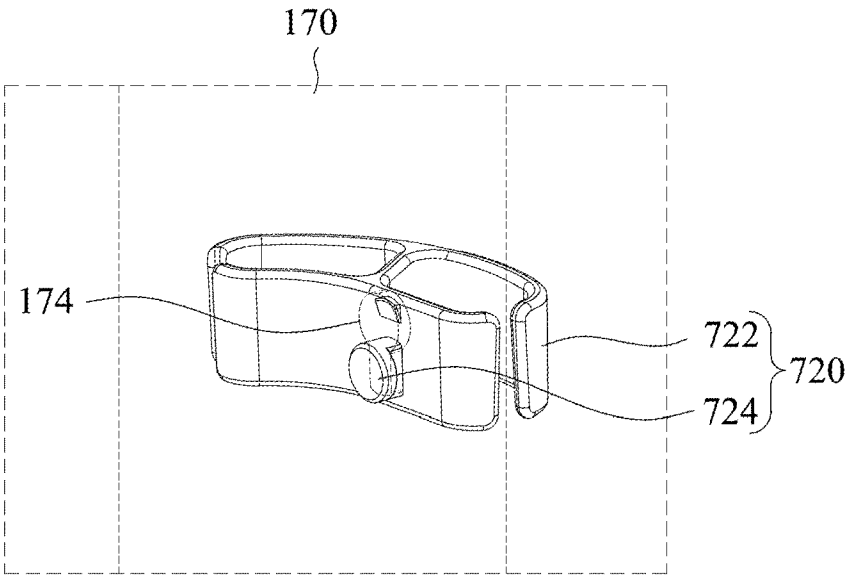
Figure 8:
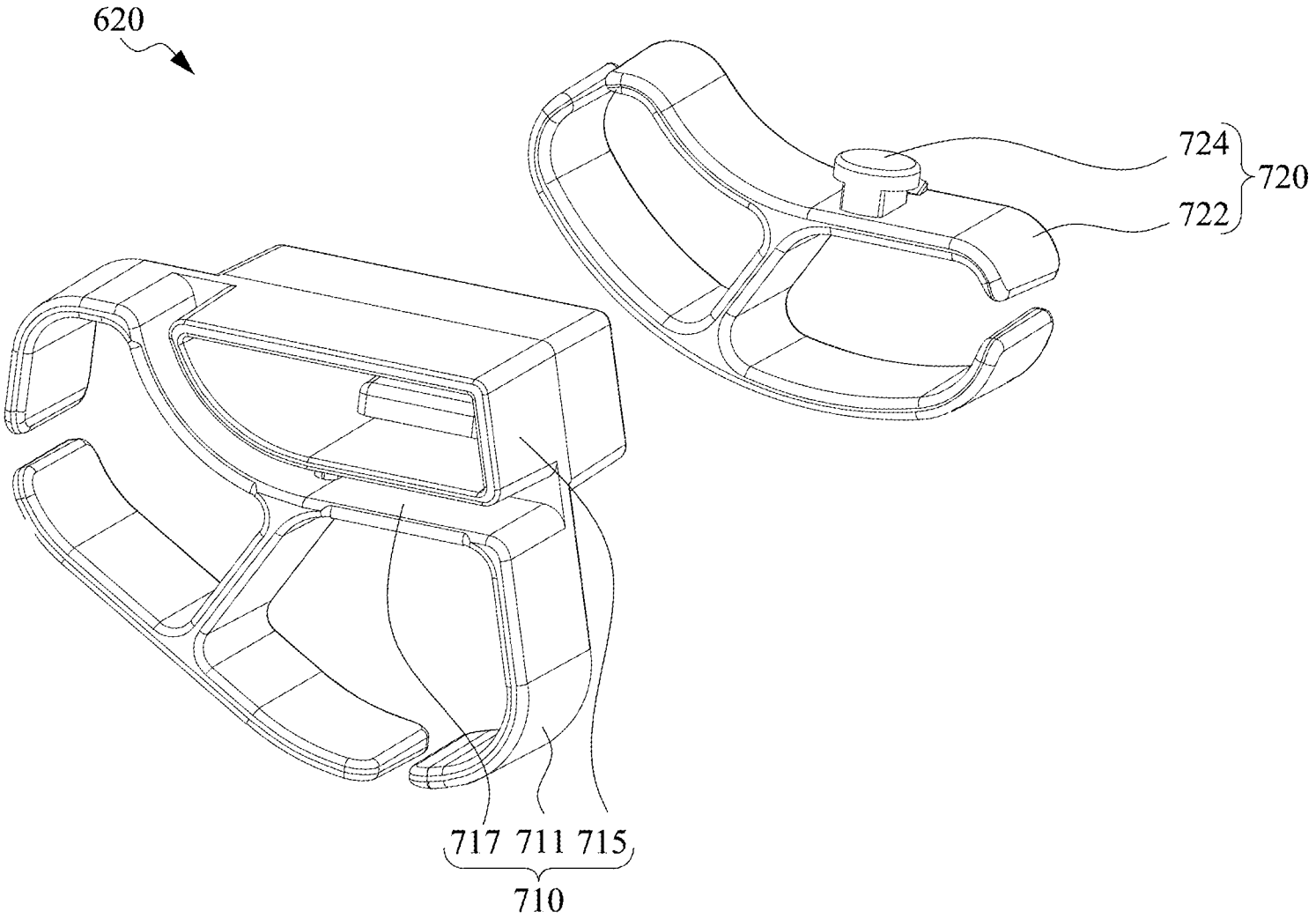
FIG. 8 is an exploded view of the wire clamp module of the folding table shown in FIG. 7 viewed from another angle.
Figure 9:
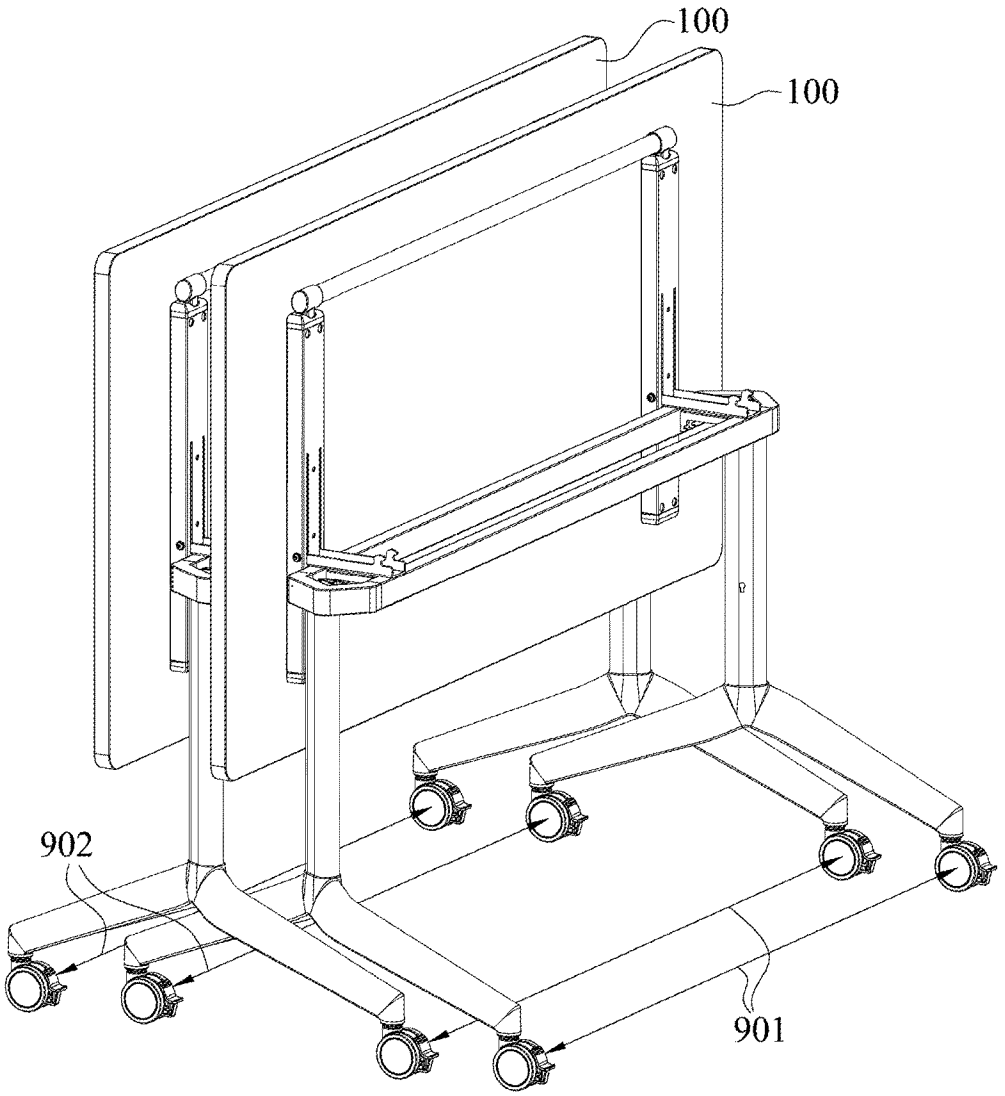
FIG. 9 is a schematic diagram of two folding tables stacked in the storage status.
Figure 10:
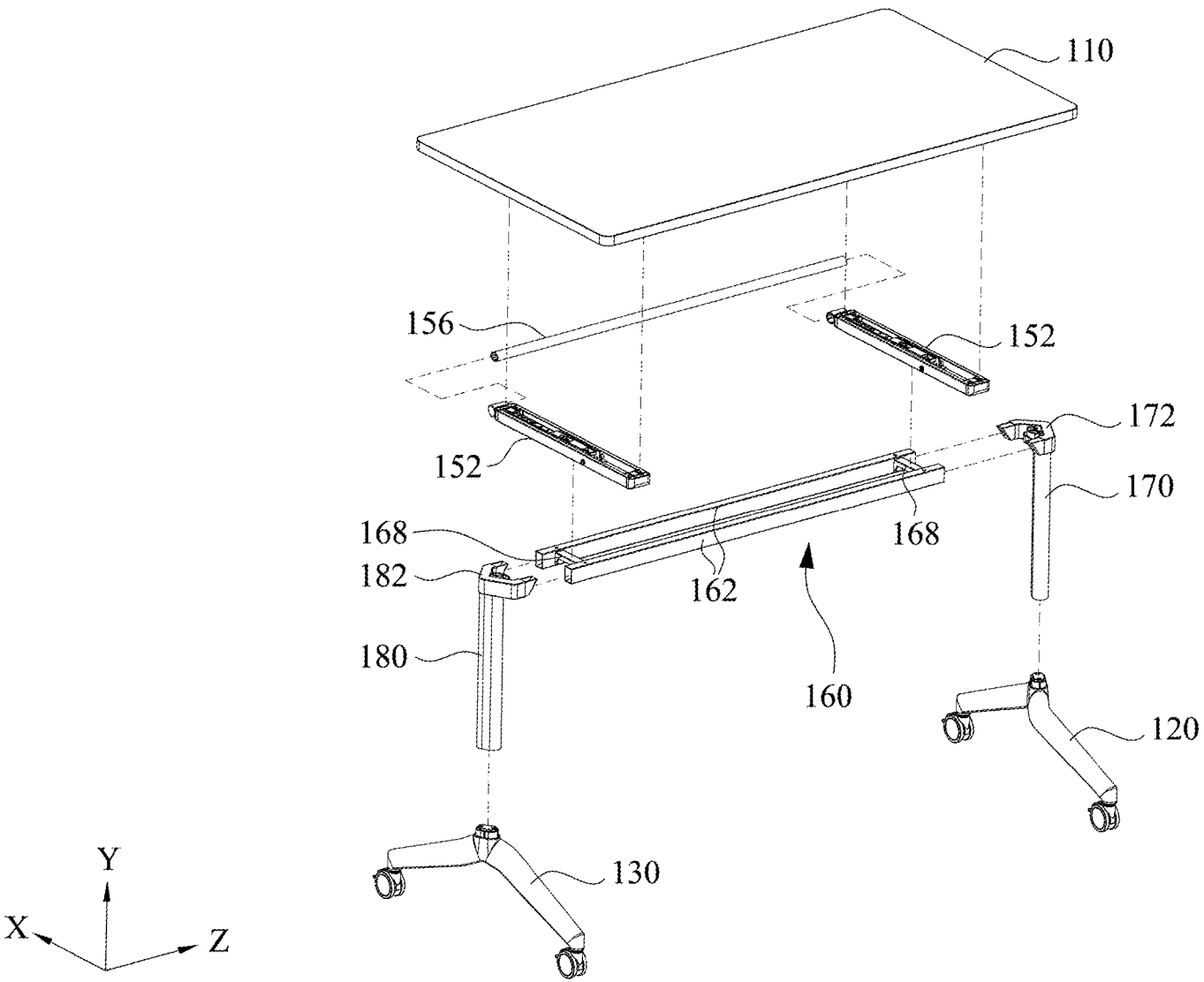
FIG. 10 is a schematic diagram of the folding table before assembly.

FIG. 1 illustrates a schematic perspective diagram of a folding table according to one embodiment of the present invention, and FIG. 2 is a schematic diagram of the folding table in a storage status. FIG. 3 is a schematic perspective diagram of the folding frame of the folding table, FIG. 4 is a schematic rear view thereof, and FIG. 5 is an exploded schematic diagram of partial components thereof. FIG. 6 is a schematic diagram of the connecting joint of the supporting column and the supporting frame of the folding table before assembly. FIG. 7 and FIG. 8 are schematic diagrams illustrated the wire clamp module of the folding table. FIG. 9 is a schematic diagram illustrated two folding tables stacked in the storage status. In addition, FIG. 10 is a schematic diagram of the folding table before assembly.

First referring to FIG. 1 and FIG. 2, as shown in the drawings, the folding table 100 includes a table board 110, a folding module 150, a supporting frame 160, a supporting column 170, a supporting column 180, a caster foot 120 and a caster foot 130. The folding module 150 is fixed between the table board 110 and the supporting frame 160 to allow the table board 110 able to rotate and fix on the supporting frame 160. When using the folding table 100, the table board 110 may be fixed at a position approximately parallel to the ground. When the folding table 100 is stored, the table board 110 may be fixed at a position approximately perpendicular to the ground but not limit to this. The table board 110 can be fixed at different angles according to user needs, so as to be suitable for various use and storage states, without departing from the spirit and protection scope of the present invention.

In addition, the supporting column 170 and the supporting column 180 are installed on the two sides of the supporting frame 160, and the caster foot 120 is installed under the supporting column 170, the caster foot 130 is installed under the supporting column 180 to conveniently move and fix the folding table 100.

In some embodiments, the supporting frame 160 includes two supporting beams 162 and two connecting brackets 168 fixed on two ends of the supporting beams 162 to form a rectangular supporting frame to effectively increase the rigidity of the folding table 100 so as to improve safety and reliability during use.

In addition, a connecting joint 172 and a connecting joint 182 are respectively formed on the supporting column 170 and the supporting column 180. The connecting joint 172 and the connecting joint 182 may be respectively inserted into two ends of the supporting frame 160 and fixed by the fixing devices such as screws. Because that the connecting joint 172 and the connecting joint 182 are respectively inserted into the two ends of the supporting beams 162 of the supporting frame 160, the rigidities of the supporting frame 160 and the folding table 100 are further improved so as to further improve safety and reliability of the folding table 100 during use.

In addition, the folding module 150 includes two folding frames 152 and a release rod 156. The folding frames 152 are respectively fixed on two ends of the lower surface of the table board 110, and the release rod 156 is connected between the folding frames 152.

Simultaneously referring to FIG. 3 to FIG. 5, as shown in the drawings, the folding frame 152 includes a connecting rod 340, a release slide block 350, a slide rail 360 and an L shaped lock 320. The release slide block 350 includes a plurality of length adjustment holes 352, and the connecting rod 340 is connected to the length adjustment holes 352 and fixed to a corresponding length adjustment hole 352 according to a required length. Therefore, the folding frames 152 may be utilized with different size table boards 110. By fixing the connecting rod 340 with a corresponding length adjustment hole 352 of the release slide block 350, the total length of the connecting rod 340 and the release slide block 350 can be effectively adjusted so that the release rod 156 installed at the end portion of the connecting rod 340 may be close to the edge surface of the table board 110 for conveniently operating.

Furthermore, the release slide block 350 is movably installed in the slide rail 360, and the L shaped lock 320 is pivoted on the slide rail 360. In some embodiments, the slide rail 360 includes a rotating shaft 330 and the L shaped lock 320 is pivotally connected to the rotating shaft 330. In some embodiments, the rotating shaft 330 is a plastic rotating shaft or a metal shaft with a plastic bushing to reduce the noise during rotation and reduce the shift of the L shaped lock 320 so as to improve the rotational quality and stability. In some embodiments, the rotating shaft 330 has a plastic rotating shaft or a plastic bushing made of polyvinyl chloride polymer (PVC), Nylon such as Nylon 66 or Nylon 6, or the like.

In some embodiments, the L shaped lock 320 includes a first claw 322 and a second claw 324. The second claw 324 is located at one end of the L shaped lock 320 adjacent to the rotating shaft 330, and the first claw 322 is located at another end of the L shaped lock 320 opposite to the rotating shaft 330. The release slide block 350 includes a first positioning pin 354 and a second positioning pin 356. The second positioning pin 356 is located at one end of the release slide block 350 adjacent to the rotating shaft 330, and the first positioning pin 354 is located at another end of the release slide block 350 opposite to the rotating shaft 330.

The first claw 322 is utilized to engage with the first positioning pin 354 to fix the table board 110 in a horizontal position, as shown in FIG. 1. That is to say, the table board 110 is in a horizontal status for users to use. In addition, the second claw 324 is utilized to engage with the second positioning pin 356 to fix the table board 110 in a vertical position, as shown in FIG. 2, so as to save the occupied space of the folding table 100. Furthermore, after the second claw 324 engages with the second positioning pin 356, the table board 110 can effectively avoid accidental rotation so that the user may safely move the folding table 100 to a desired position for storage so as to further increase the safety and convenience of the folding table 100 when in use.

It is worth noting that the folding frames 152 further includes a protective shell 310 to accommodate the release slide block 350, the slide rail 360, a portion of the connecting rod 340 and a portion of the L shaped lock 320. The second claw 324 of the L shaped lock 320 and the second positioning pin 356 of the release slide block 350 are effectively hidden in the protective shell 310.

Therefore, because the second claw 324 of the L shaped lock 320 and the second positioning pin 356 of the release slide block 350 are effectively hidden in the protective shell 310, the finger of the user or any other person close to the folding table 100 cannot touch the second claw 324 of the L shaped lock 320 and the second positioning pin 356 of the release slide block 350 when the table board 110 is in the vertical position so as to effectively prevent fingers from being pinched and injured. In addition, the protective shell 310 and the hidden second claw 324 of the L shaped lock 320 and the hidden second positioning pin 356 of the release slide block 350 may further enhance the aesthetic feeling of the overall appearance of the folding frames 152 so as to further increase the quality of the folding table 100.

In some embodiments, the first positioning pin 354 and the second positioning pin 356 of the release slide block 350 preferably respectively includes a plastic positioning pin bushing 355 and a plastic bushing plastic positioning pin bushing 357 to further reduce the operational noise and improve the operational quality and stability. In some embodiments, the plastic positioning pin bushing 355 and the plastic positioning pin bushing 357 are made of polyvinyl chloride polymer (PVC), Nylon such as Nylon 66 or Nylon 6, or the like.

In some embodiments, the protective shell 310 includes two openings 314 to allow at least portion of the L shaped lock 320 and the first claw 322 formed on the L shaped lock 320 to be hidden in the protective shell 310 so as to increase the rotational angle of the L shaped lock 320 and prevent the protective shell 310 from interfering with the rotational angle of the L shaped lock 320.

In some embodiments, the two ends of the protective shell 310 include an end cap 316 and an end cap 318 to conveniently fix the folding frames 152 on the lower surface of the table board 110 with fixing devices such as screws. In addition, the end cap 316 further includes an opening 317 to expose a portion of the connecting rod 340 outside the end cap 316 and the protective shell 310 so as to effectively connect with the release rod 156.

In some embodiments, the folding frames 152 further includes a return spring 358 to reposition the release slide block 350 when the user releases the release rod 156 of the folding frames 152 so as to stably engage the first positioning pin 354 with the first claw 322 or the second positioning pin 356 with the second claw 324 to fix the table board 110 at the horizontal position during operation or the vertical position during storage.

In some embodiments, the slide rail 360 further includes a first long hole 362 and a second long hole 364 to allow the first positioning pin 354 and the second positioning pin 356 respectively passing through the first long hole 362 and the second long hole 364 and exposing to the outside of the slide rail 360 so as to respectively engage with the first claw 322 and the second claw 324. In addition, the first long hole 362 and the second long hole 364 may further limit the stroke of the release slide block 350 and increase the stability of the release slide block 350 sliding in the slide rail 360.

Referring to FIG. 6, as shown in the drawing, the connecting joint 172 of the supporting column 170 and the supporting frame 160 of the folding table 100 are illustrated before assembly. The connecting joint 172 of the supporting column 170 is preferably formed with a U shaped structure and two ends of the U shaped structure are respectively inserted into the supporting beams 162 of the supporting frame 160 to effectively increase the rigidity and stability of the supporting frame 160. In addition, it is worth noting that the connecting joint 172 of the supporting column 170 further includes an inclined connection surface 650, and the supporting frame 160 further includes an inclined fixing surface 660 formed in the supporting beams 162. When the inclined connection surface 650 and the inclined fixing surface 660 are fixed by the fixing screws 610, the rigidity and stability of the supporting column 170 and the supporting frame 160 are effectively improved so as to increase the overall rigidity and stability of the folding table 100.

In some embodiments, the inclined connection surface 650 and the inclined fixing surface 660 have an inclined angle of 30 to 60 degrees, preferably 45 degrees, to increase the ability of the supporting column 170 and the supporting frame 160 to withstand horizontal and vertical forces. Similarly, the connecting joint 182 of the supporting column 180 and the supporting frame 160 also have the inclined connection surfaces to increase the ability of the supporting column 180 and the supporting frame 160 to withstand horizontal and vertical forces.

In addition, as shown in FIG. 6, the connecting brackets 168 of the supporting frame 160 further include wire fixing hooks 630 to fix the power wires or signal wires so that the power wires, signal wires and electrical devices such as power sockets can be safely equipped in the rectangular opening formed by the supporting frame 160.

In some embodiments, the folding table 100 further includes a wire clamp module 620 installed on the top portion of the supporting column 170.

Simultaneously referring to FIG. 7 and FIG. 8, the wire clamp module 620 includes a first wire holder 710 and a second wire holder 720, the first wire holder 710 may be installed on the top portion of the supporting column 170, and the second wire holder 720 is detachably stored on the first wire holder 710.

In some embodiments, the first wire holder 710 includes wire clamping channels 711, a storage groove 713, a fixing base 715 and an arc groove 717. The second wire holder 720 includes wire clamping channels 722 and a storage boss 724.

The arc groove 717 of the first wire holder 710 has the same arc shape as the end portion of supporting column 170 to detachably fix the first wire holder 710 to the end portion of the supporting column 170. The storage groove 713 is formed on the upper surface of the fixing base 715 to fix the storage boss 724 of the second wire holder 720 therein so as to simultaneously fix the second wire holder 720 on the end portion of the supporting column 170. In addition, it is worth noting that the second wire holder 720 can detach from the storage groove 713 of the first wire holder 710 and be installed to the wire clamp fixing hole 174 (referring to left portion of FIG. 7 and FIG. 1) so that the user may clamp required cables with the wire clamping channels 722 of the second wire holder 720 fixed in the wire clamp fixing hole 174, the wire clamping channels 711 of the first wire holder 710 and the wire fixing hook 630 of the connecting brackets 168 fixed on the supporting frame 160 so that the power cables may be conveniently and safely installed in the folding table 100. Similarly, the first wire holder 710 may be installed on the supporting column 180, and the second wire holder 720 is detachably fixed on the wire clamp fixing hole 184 of the supporting column 180 (referring to FIG. 2).

In addition, referring to FIG. 9, as shown in the drawing, two folding tables 100 are stacked together. Each folding table 100 has a caster foot 120 and a caster foot 130 with a first span 901 and a second span 902 therebetween, and the first span 901 is greater than the second span 902. In general, when the table board 110 is under the horizontal position, the first span 901 is located close to the release rod 156. That is to say, the first span 901 is located close to a user so as to conveniently operate the folding table 100 and store the folding table 100.

Referring to FIG. 10, as shown in the drawing, the folding table 100 is illustrated before assembly. In order to facilitate storage and transportation, the folding table 100 is a modular folding table, and the folding table 100 has a small packaging volume for convenient transportation and the folding table 100 can be easily assembled. The folding table 100 may be detached to a table board 110, a folding module 150 (including two folding frames 152 and a release rod 156), a supporting frame 160, a supporting column 170, a supporting column 180, a caster foot 120 and a caster foot 130. Before assembly, the foregoing components may tightly store in a rectangular packaging box. After the user received the packaging box, the user may place the upper surface of the table board 110 on the opened packaging box or the ground, insert the release rod 156 into end portions of the connecting rods 340 of the two folding frames 152, and fix the two folding frames 152 on the lower surface of the table board 110. Subsequently, the supporting frame 160 is fixed on the folding frames 152, and then the supporting column 170 and the supporting column 180 are inserted into the two end portions of the supporting frame 160. Finally, the caster foot 120 and the caster foot 130 are respectively installed to the supporting column 170 and the supporting column 180. Users may easily install the folding table 100 with hand tools or electric tools. After the assembly of the folding table 100 is completed, the user only needs to turn the upper surface of the table board 110 upwards to start using the folding table 100.

Accordingly, the folding table disclosed in the present invention can not only be conveniently stored and transported, but also can be conveniently installed and accommodated, and the overall rigidity and strength of the folding table can be effectively improved through the enhanced structural design. In addition, the positioning pins and the claws hidden in the protective shell may increase the safety during use, and effectively improve the utilization field and safety of the folding table.

The foregoing description is only the preferred embodiments of the present invention, and cannot limit the implement scope of the present invention, and all the simple equivalent changes that are achieved according to the content of description and modifications of the present invention are still within the scope of the present invention. In addition, any embodiment of the present invention or the claim of the patent invention does not need to achieve all the purposes or advantages or features disclosed in the present invention. In addition, the abstract and the title are only used to assist in the search of patent documents, not to limit the scope of the present invention. In addition, terms such as "first" and "second" mentioned in this specification or the claim of the patent invention are only used to name the component or to distinguish different embodiments or scopes, but not to limit the upper or lower limit on the number of components.

Although the present disclosure has been disclosed above in terms of implementation, it is not intended to limit the present disclosure. Any person with ordinary knowledge in the field may make various variations and modifications without departing from the spirit and scope of the disclosure. Therefore, the spirit and scope of the appended claims should not be limited to the description of the embodiments contained herein.

What is claimed is:

1. A folding table, comprising:

a table board;

a supporting frame;

a folding module fixed between the table board and the supporting frame to allow the table board able to rotate and fix on the supporting frame;

a plurality of supporting columns installed to the supporting frame; and a plurality of caster feet respectively installed to the supporting columns, wherein the folding module comprises:

two folding frames respectively fixed on two ends of a lower surface of the table board; and a release rod connected between the folding frames, wherein each of the folding frames comprises:

a connecting rod;

a release slide block, wherein the release slide block comprises a plurality of length adjustment holes, the connecting rod is connected to one of the length adjustment holes;

a slide rail, wherein the release slide block is movable to be installed in the slide rail; and an L shaped lock pivoting on the slide rail.

2. The folding table of claim 1, wherein each of the supporting columns comprises a connecting joint inserted into the supporting frame to connect together, wherein the connecting joint comprises an inclined connection surface to connect to an inclined fixing surface of the supporting frame.

3. The folding table of claim 1, wherein the supporting frame comprises:

two supporting beams; and two connecting brackets fixing two ends of the supporting beams to form a rectangular supporting frame, wherein the connecting brackets comprise wire fixing hooks to fix power wires or signal wires.

4. The folding table of claim 1, wherein the L shaped lock comprises a first claw and a second claw, wherein the release slide block comprises a first positioning pin and a second positioning pin, the first claw is configured to lock to the first positioning pin, and the second claw is configured to lock to the second positioning pin to position the table board in a horizontal position or a vertical position.

5. The folding table of claim 4, wherein each of the folding frames further comprises a protective shell accommodating the release slide block, the slide rail, a portion of the connecting rod and a portion of the L shaped lock, wherein the second claw of the L shaped lock and the second positioning pin of the release slide block are hidden in the protective shell.

6. The folding table of claim 5, wherein the first positioning pin and the second positioning pin of the release slide block respectively comprise a plastic positioning pin bushing, the L shaped lock is pivotally connected to a rotating shaft of the slide rail, and the rotating shaft is a plastic rotating shaft.

7. The folding table of claim 1, further comprising two wire clamp modules installed on the supporting columns, wherein each of the wire clamp modules comprises:

a first wire holder installed on one of the supporting columns; and a second wire holder detachably connected to the first wire holder, wherein the second wire holder is configured to be installed on a wire clamp fixing hole of the one of the supporting columns when the second wire holder and the first wire holder are separated.

8. The folding table of claim 1, wherein the caster feet comprise a first span and a second span, the first span is greater than the second span, and the first span is adjacent to the release rod.

9. A folding table, comprising:

a table board;

a supporting frame;

a folding module fixed between the table board and the supporting frame to allow the table board able to rotate and fix on the supporting frame;

a plurality of supporting columns installed to the supporting frame;

a plurality of caster feet respectively installed to the supporting columns; and two wire clamp modules installed on the supporting columns, wherein each of the wire clamp modules comprises:

a first wire holder installed on one of the supporting columns; and a second wire holder detachably connected to the first wire holder, wherein the second wire holder is configured to be installed on a wire clamp fixing hole of the one of the supporting columns when the second wire holder and the first wire holder are separated.

* * * * *